United States Patent [19]

Reilly, Sr.

[11] 4,192,112

[45] Mar. 11, 1980

[54] PLIABLE AWNING SYSTEM

[76] Inventor: Robert M. Reilly, Sr., 810 Barry St., Miami Beach, Fla. 33140

[21] Appl. No.: 946,764

[22] Filed: Sep. 28, 1978

[51] Int. Cl.[2] ..... E04B 1/12

[52] U.S. Cl. ..... 52/222; 160/46; 160/65

[58] Field of Search ..... 52/74, 222; 160/47, 160/50, 64, 76, 77, DIG. 5, 388, 392, 65, 46; 49/71; 135/5 AT, 5 R

[56] References Cited

U.S. PATENT DOCUMENTS

| | | | |
|---|---|---|---|
| 2,189,567 | 2/1940 | Miller | 160/DIG. 5 |
| 2,423,402 | 7/1947 | Olsen | 160/46 X |
| 2,547,692 | 4/1951 | D'Azzo | 160/392 X |
| 2,720,885 | 10/1955 | Legg | 160/392 X |
| 2,787,321 | 4/1957 | Dietz | 160/47 |
| 3,720,438 | 3/1973 | Johnson et al. | 160/46 X |

FOREIGN PATENT DOCUMENTS

| | | | |
|---|---|---|---|
| 204449 | 6/1956 | Australia | 160/46 |

*Primary Examiner*—James A. Leppink
*Assistant Examiner*—Carl D. Friedman
*Attorney, Agent, or Firm*—Salvatore G. Militana

[57] ABSTRACT

A pliable awning system consisting of a head bar means adapted to be mounted on a building and the like for support and a front bar means adapted to be mounted on posts and the like with a pliable awning extending between the building and the posts; the awning having securing means fastened to both ends for securing said awning to said head bar means and said front bar means with adjustable means mounted on the front bar means for rendering the pliable awning taut.

9 Claims, 3 Drawing Figures

PLIABLE AWNING SYSTEM

BACKGROUND OF THE INVENTION

1. Field Of The Invention

This invention relates to awning structures and is more particularly directed to a pliable awning with head and front bar means for adjustably securing the ends of the awning to permit the awning to extend at any desired degree of tautness.

2. Description Of The Prior Art

At the present time pliable awnings extending between support structures have their ends lashed to the support structures by ropes or lines threaded through eyelets secured to the ends of the pliable awning. Not only is this manner of securing a pliable awning in place laborious and costly in manpower but also is difficult in preventing the awning from having wrinkles or ripples appear thereon. The present invention contemplates avoiding these objections.

SUMMARY OF THE INVENTION

Therefore a principal object of the present invention is to provide a pliable awning system that is readily erected between support members and just as readily dismantled therefrom.

Another object of the present invention is to provide a pliable awning system which permits the use of non-skilled labor to erect and dismantle the pliable awning.

A further object of the present invention is to provide a pliable awning system wherein the pliable awning is readily erected without wrinkles or ripples.

With these and other objects in view, the invention will be best understood from a consideration of the following detailed description taken in connection with the accompanying drawing forming a part of this disclosure, with the understanding, however, that the invention is not confiend to any strict conformity with the showing of the drawing but may be changed or modified so long as such changes or modifications mark no material departure from the salient features of the invention as expressed in the appended claims.

Figure 1:
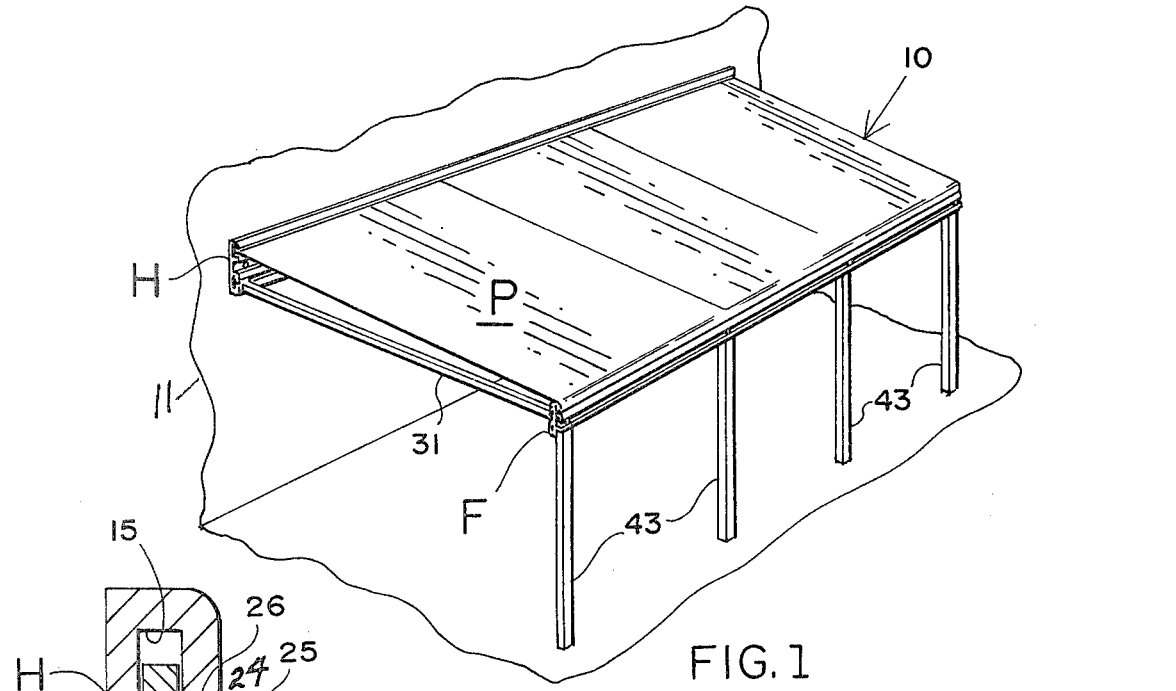
FIG. 1 is a perspective view of a pliable awning system constructed in accordance with my invention and shown mounted on and extending from a wall of a building.

Referring to the drawing wherein like numerals are used to designate similar parts throughout the several views, the numeral 10 refers to my fabric awning system consisting of a head bar structure -H- secured to a wall 11 of a building, a front bar structure -F- and a pliable sheet material -P- having its ends secured to the head bar structure -H- and front bar structure -F- and extendinhg in a taut and wrinkle free condition therebetween. It is to be noted that the pliable sheet material -P- utilized in my awning system may consist of fabric such as canvas, sheet plastic and light sheet metal preferably of aluminum.

Figure 3:
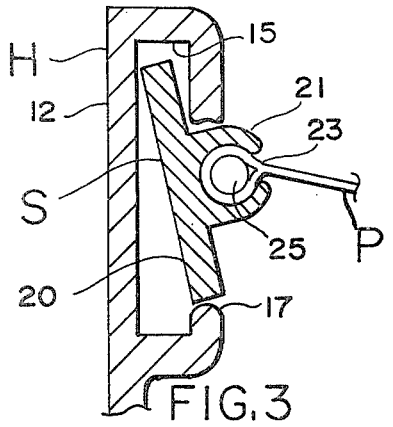
FIG. 3 is a fragmentary view of FIG. 2 showing the manner of removing the slide bar from the head bar.

The head bar structure -H- as well as the front bar structure -F- are constructed entirely of extruded members as is explained in detail hereinafter, thereby reducing the cost of manufacture to a minimum. The head bar structure -H- consists of a flat back member 12 that is positioned against the wall 11 and secured thereto by screw bolts 13 extending through openings 14 in the back member 12. The head bar -H- is provided with a pair of longitudinally extending slotted portions 15 and 16 extending the full length thereof. The slotted portions 15 and 16 are provided with longitudinal openings 17 and 18 respectively to permit the insertion of the sliding members -S- and -B- therein. The sliding member -S- consists of a flat wall portion 20 that is slidably mounted in the slotted portion 15 with an awning securing portion 21 projecting forwardly thereof with a cylindrical bore 22 and opening 23 extending along its full length. The pliable awning -P- is anchored to the slide bar -S- by a loop portion 24 formed at one end of the awning -P- with a dowel 25 received in the loop 24 and positioned in the bore 22 and extending through the opening 23 in the direction of the front bar -F-. A resilient cylindrical locking member 26 is wedged in position in the opening 17 between the upper portion of the opening 17 and the top surface anchoring portion 21. Upon removing the locking member 26 from between the head bar -H- and slide bar -S-, the slide bar -S- can be lifted and tilted forwardly in the slotted portion 15 until the lower end of the flat wall 20 clears the bottom portion of the opening 17 as shown by FIG. 3.

Within the longitudinal slot 16 at the base of the head bar -H- there are provided a plurality of slide bolts -B- each consisting of a slide member 27 with a bolt 28 extending forwardly thereof. Received by the bolt is an L-shaped bracket -LH- having a leg portion 29 secured to the end of the rafter 31 and the other leg portion 30 received on the bolt 28 and secured thereon by a nut 32 threaded on the bolt 28.

The front bar -F- likewise is provided with a pair of longitudinal slotted portion 33 and 34 in which sliding members 35 and 36 are slidably mounted therein; the members 35 and 36 having threaded bolts 37 and 38 extending outwardly thereof. The bolt 37 extends through an opening in the leg 39 of an L-shaped bracket -LF- whose other leg 40 is secured to the rafter 31. The bolt 38 extends through an opening in the leg 41 of the bracket -LG- while the other leg 42 is secured to the top portion of a post 43. Nuts 37 and 38 are threadedly mounted on the bolts 37 and 38 to secure the front bar -F- to the post 43 and the rafter 31 to the front bar -F-.

At the forward side of the front bar -F- there is an arcuate crown portion 46 in which an awning anchoring member 47 is positioned. The anchoring member 47 is provided with a longitudinal bore 48 having a longitudinal opening 49 for receiving a dowel 50 which extends through the loop 51 formed at the end of the pliable awning -P-. At the bottom portion of the front bar -F- is a further longitudinal slot 52 with an opening 53 to receive a slide member 53 mounted on the end of a threaded bolt 54. The bolt 54 extends through an opening 55 in a flange 56 extending from the lower portion of the front bar -F-. A nut 56 secures the bolt 54 against movement and serves to maintain the pliable fabric -P- in a taut condition. As is noted by FIG. 1, a plurality of posts 43 are utilized and a like number of rafters 31 or more if deemed necessary extending between the head bar -H- and front bar -F-.

Figure 2:
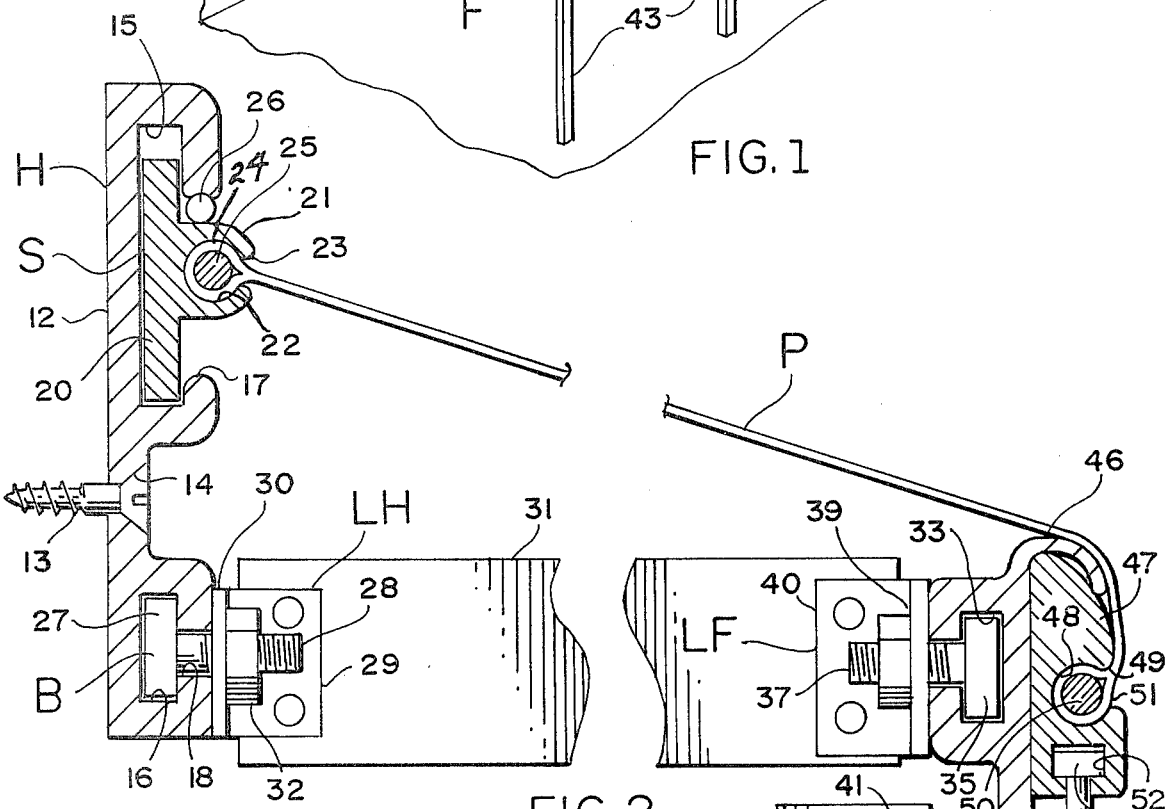
FIG. 2 is a cross sectional view taken along the lines 2—2 of FIG. 1.

In the normal use of my pliable awning system, the head bar -H- and front bar -B- are mounted to support the pliable awning -P- as shown by FIGS. 1 and 2 or without the rafter support structure if such is desired. Also, the head bar -H- may be used at one end of a pliable awning -P- with a second head bar -H- at the other end in lieu of the front bar -F-. In addition, two front bars -F- may be used, namely, as in a tent with the mid-portion of the pliable awning -P positioned higher than those of the two front bars -F-.

Having described my invention in connection with the accompanying drawing, what I claim as new and desire to secure by Letters Patent is:

1. An awning system comprising head bar means adapted to be secured to a building, front bar means adapted to be supported in space relation to said head bar means, a pliable awning extending between said head bar means and said front bar means, adjustable means mounted on said front bar means maintaining said pliable awning in a taut condition, said head bar means comprising a longitudinally disposed slotted portion having an opening, and awning securing member slidably mounted in said slotted portion and extending through said opening, pliable securing means mounted in said opening and engaging said awning securing member whereby upon removal of said pliable securing means, said awning securing member may be removed from said slotted portion through said opening.

2. The structure as recited by claim 1 taken combination with said head bar means and said front bar means each having rafter engaging means and a rafter extending between said head bar means and said front bar means at said rafter engaging means.

3. The structure as recited by claim 2 wherein said front bar means comprises a base portion adapted to be secured to a support means said base portion having a substantially arcuate crown portion and a flange portion mounted in substantially opposing relation, awning securing means engaging said crown portion, said pliable awning extending over said crown portion and having one end secured to said awning securing means, and said adjustable means comprising bolt means extending from said awning securing means to said flange portion for adjusting the tautness of said pliable awning.

4. The structure as recited by claim 3 wherein said rafter engaging means of said head bar means and said front bar means each comprise an L-shaped bracket having one leg portion secured to said rafter, a bolt having a head portion slidably mounted on both of said bar means and extending through the other leg portion and a nut threadedly mounted on said bolts and engaging said other leg portion.

5. The structure as recited by claim 4 taken in combination with means securing said front bar means to said support means comprises a further L-shaped bracket having one leg portion secured to said support means, a further bolt having a head portion slidably mounted on said front bar means and extending through the other leg portion and a nut threadedly mounted on said bolt and engaging said other leg portion.

6. A head bar for pliable awnings comprising an elongated base portion, a slotted portion mounted along said base portion, said slotted portion having an opening, said opening having a top wall portion, an awning securing member having a substantially flat wall portion mounted in said slotted portion, said flat wall portion having a flange extending outwardly through said opening, a flexible member mounted between said top wall portion and said flange, said flange having a second slotted portion on the free end thereof, a second opening at said second slotted portion for receiving a loop formed on one end of said awning and a dowel mounted in said second slotted portion, said dowel being received by said loop and being larger than said opening whereby said awning is secured to said head bar and upon removal of said flexible member, said awning securing member may be removed from said first named slotted portion through said first named opening.

7. A front bar for pliable awnings having a loop formed at one end thereof comprising a flat wall portion, a substantially arcuate crown portion mounted on one end of said flat wall portion, member slidably mounted along said flat wall portion and engaging said crown portion, a slotted portion mounted on said slidable member in proximity of said crown portion, said slotted portion having an opening for receiving said loop formed in one end of said awning and a dowel mounted in said slotted portion, said dowel being received by said loop and being larger than said opening whereby said awning is secured to said front bar, a second slotted portion mounted on said slidable member, said second slotted portion having a second opening, a flange mounted on said flat wall portion opposing said second opening, a bore in said flange, a second slidable member mounted in said second slotted portion, a threaded member secured at one end to said second slidable member and extending through said bore and a nut threadedly mounted on said other end of said threaded member and engaging said flange for sliding said first named slidable member toward and away from said arcuate crown in adjusting said awning.

8. The structure as recited by claim 7 taken in combination with awning adjusting means mounted on said flat wall portion in proximity to said slotted portion.

9. The structure as recited by claim 8 wherein said awning adjusting means comprises a second slotted portion mounted on said slidable member, said second slotted portion having a second opening, a flange mounted on said flat wall portion opposing said second opening, a bore in said flange, a second slidable member mounted in said second slotted portion, a threaded member secured at one end to said second slidable member and extending through said bore and a nut threadedly on said other end of said threaded member and engaging said flange for sliding said first named slidable member toward and away from said arcuate crown in adjusting said awning.

* * * * *